US006170789B1

(12) United States Patent
Hayakawa

(10) Patent No.: US 6,170,789 B1
(45) Date of Patent: Jan. 9, 2001

(54) APPLIANCE FOR SUPPORTING CARRIAGE OF CYLINDRICAL ARTICLE

(75) Inventor: Hiroshi Hayakawa, Tokyo (JP)

(73) Assignee: Ecology Development Corp., Tokyo (JP)

( * ) Notice: Under 35 U.S.C. 154(b), the term of this patent shall be extended for 0 days.

(21) Appl. No.: 09/310,158

(22) Filed: May 12, 1999

(30) Foreign Application Priority Data

May 14, 1998 (JP) ..... 10-148289

(51) Int. Cl.[7] ..... A47B 91/00
(52) U.S. Cl. ..... 248/346.01; 248/49
(58) Field of Search ..... 248/346.01, 175, 248/65, 67.7, 74.1, 160, 74.2, 49, 70

(56) References Cited

U.S. PATENT DOCUMENTS 4,291,855 * 9/1981 Schenkel et al. ..... 248/74.1
4,566,660 * 1/1986 Anscher et al. ..... 248/74.1
5,616,036 * 4/1997 Polidori ..... 248/74.1 X

* cited by examiner

*Primary Examiner*—Ramon O. Ramirez
(74) *Attorney, Agent, or Firm*—Armstrong, Westerman, Hattori, McLeland & Naughton

(57) ABSTRACT

An appliance for supporting carriage of a cylindrical article which consists essentially of two proximate triangular prisms portion comprising a curved loading face of a cylindrical article with fold lines, a beam plane and a perpendicular plane and a base plane portion, wherein said two proximate triangular prisms portion is formed in the state approached to each other in parallel by bending both ends of a square cardboard sheet to a proximate triangle form in cross section toward inside of the square cardboard sheet and a floated space is formed between said two beam planes of said two proximate triangular prisms portion and said base plane portion during loading of a cylindrical article.

3 Claims, 5 Drawing Sheets

APPLIANCE FOR SUPPORTING CARRIAGE OF CYLINDRICAL ARTICLE

BACKGROUND OF THE INVENTION

1. Field of the Invention

The present invention relates to an appliance for supporting carriage of rolled or non-rolled cylindrical articles such as synthetic films, photograph film, papers, aluminum foils, cylinders for printing, in which said articles can be stably supported during carriage.

2. Prior Art

Hitherto, when a rolled article was carried, a method comprising enclosing the rolled article in a wooden box or a cardboard box in a suspended state with two holder bases for supporting both ends of a paper tube as a winding core in the center portion of the rolled article and fixing the holder bases to the bottom of the box, was applied, because the rolled article easily rolled over on a flat plane to suffer from damage.

However, in the above-mentioned method, it was required to reinforce entire strength of an enclosing box since a load was concentrated to a fixing portion of lower ends of the holder bases Further, since the rolled article in a suspended state is unstable, supporting materials to reinforce the rolled article or enclosing of them require a high cost. Small paper tube in the supporting portion made difficult handlings such as enclosing into the box or taking-out from it.

In non-rolled articles, the above-mentioned method could not be applied since they had no winding core, which resulted in inconvenience in carriage A method or an appliance in which rolled articles and non-rolled articles can be carried stably and easily in a low cost has been required.

SUMMARY OF THE INVENTION

As result of extensive studies to solve the above-mentioned prior problems, the inventors found that rolled articles and non-rolled articles can be carried stably and easily in a low cost by using an appliance for supporting carriage of a cylindrical article which consists essentially of a two proximate triangular prisms portion comprising a curved loading face of a cylindrical article with fold lines, a beam plane and a perpendicular plane and a base plane portion and accomplished the present invention.

The appliance for supporting carriage of a cylindrical article can be easily made from a cardboard sheet.

Further, a space is formed between said two beam planes of said two proximate triangular prisms portion and said base plane portion during loading of a cylindrical article. Hereinafter, the space is referred to "floated space" The floated space provides a function which makes possible to carry stably the cylindrical article loaded on the appliance.

That is, the present invention provides an appliance for supporting carriage of a cylindrical article which consists essentially of a two proximate triangular prisms portion comprising a curved loading face of a cylindrical article with fold lines, a beam plane and a perpendicular plane and a base plane portion, wherein said two proximate triangular prisms portions is formed in the state approached to each other in parallel by bending both ends of a square cardboard sheet to a proximate triangle form in cross section toward inside of the square cardboard sheet and a floated space is formed between said two beam planes of said two proximate triangular prisms portion and said base plane portion during loading of a cylindrical article.

Said proximate triangular prism may be a proximate isosceles triangular prism or a proximate right angled triangular prism Said beam plane or said perpendicular plane of said two proximate triangular prisms portion may be provided with a reinforcing plate.

DETAILED DESCRIPTION OF THE INVENTION

The cylindrical article of the present invention may be a rolled article or a non-rolled article having no winding core and has a diameter of about 300 to about 1,000 mm, a length of about 500 to 1,500 mm and a weight of 50 to 700 kg.

The appliance for supporting carriage of a cylindrical article of the present invention (hereinafter, referred to as "the present appliance") is made from a cardboard sheet. As the cardboard sheet, a cardboard sheet obtainable on a market is used and a cardboard sheet satisfying JIS specification is preferable. The thickness of the cardboard sheet is four kinds of A(5 mm), B(3 mm), AB(8 mm) and E(2 mm), and AB(8 mm) is usually used.

The present invention will be described with drawings in detail below.

Figure 1:
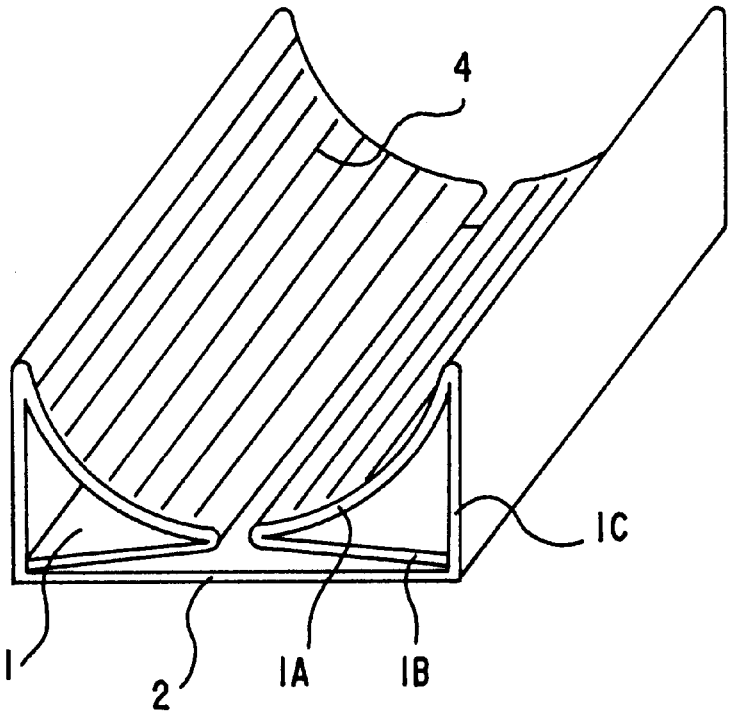
FIG. 1 is a perspective view of the appliance of the present invention.

As shown in FIG. 1, two proximate triangular prisms portion 1 is formed in the state approached to each other in parallel by bending both ends of a square cardboard sheet to a proximate triangle form in cross section toward inside of the square cardboard sheet.

As shown in FIG. 1, the present appliance consists essentially of two proximate triangular prisms portion 1 comprising curved loading face 1A of a cylindrical article with fold line 4, beam plane 1B and perpendicular plane 1C and base plane portion 2. Loading face 1A is curved to some degree in order to make easy loading of cylindrical article 6 in FIG. 2. Therefore, not accurate triangular prism, but proximate triangular prism is formed. The degree of the curve is decided considering a diameter of cylindrical article 6. Further, loading face 1A is suitably and fitly contacted with the cylindrical face of cylindrical article 6 by providing fold line 4. Fold line 4 is inserted onto loading face 1A with a fold line inserting machine.

Figure 2:
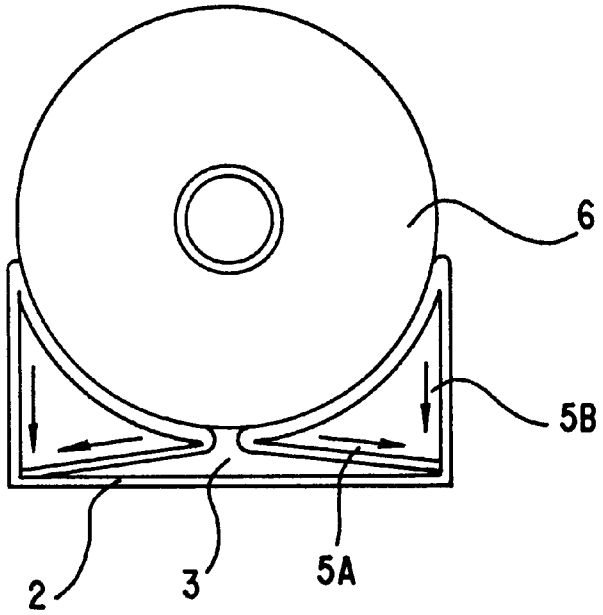
FIG. 2 is a front view of the appliance of the present invention loaded a cylindrical article.

The most significant feature of the present invention is, as shown in FIG. 2, in that floated space 3 is formed between two beam plane 1B of two proximate triangular prisms portion 1 and base plane portion 2 during loading of cylindrical article 6. Both horizontal stress 5A and vertical load 5B shown in FIG. 2 are imposed in the direction in which both beam plane 1B and perpendicular plane 1C contact base plane portion 2, by loading cylindrical article 6 on loading face 1A, so that floated space 3 is formed toward the direction to float loaded cylindrical article 6. Floated space 3 provides to the present appliance a function in which vibration and impact during carriage of loaded cylindrical article 6 are absorbed into floated space 3 and mitigated, whereby cylindrical article 6 can be stably carried and the present appliance can stand the load of cylindrical article 6.

Floated space 3 is formed, for example, where length (2R) of base plane portion 2 is equal to diameter (2R) of cylindrical article 6 and curved length of loading face 1A: length of beam plane 1B: length of perpendicular plane 1C is 1.4R:R:R. However, this is one example and the formation of floated space 3 is not limited to said example.

When cylindrical article 6 is loaded on loading face 1A, the weight load is imposed uniformly on entire of loading face 1A and then dispersed to beam plane 1B and perpendicular plane 1C.

As a result of loading test of the present appliance, maximum loading capacity is 3,200 kg. A cylindrical article with a weight of 800 kg or below is usually applied considering security.

Figure 3:
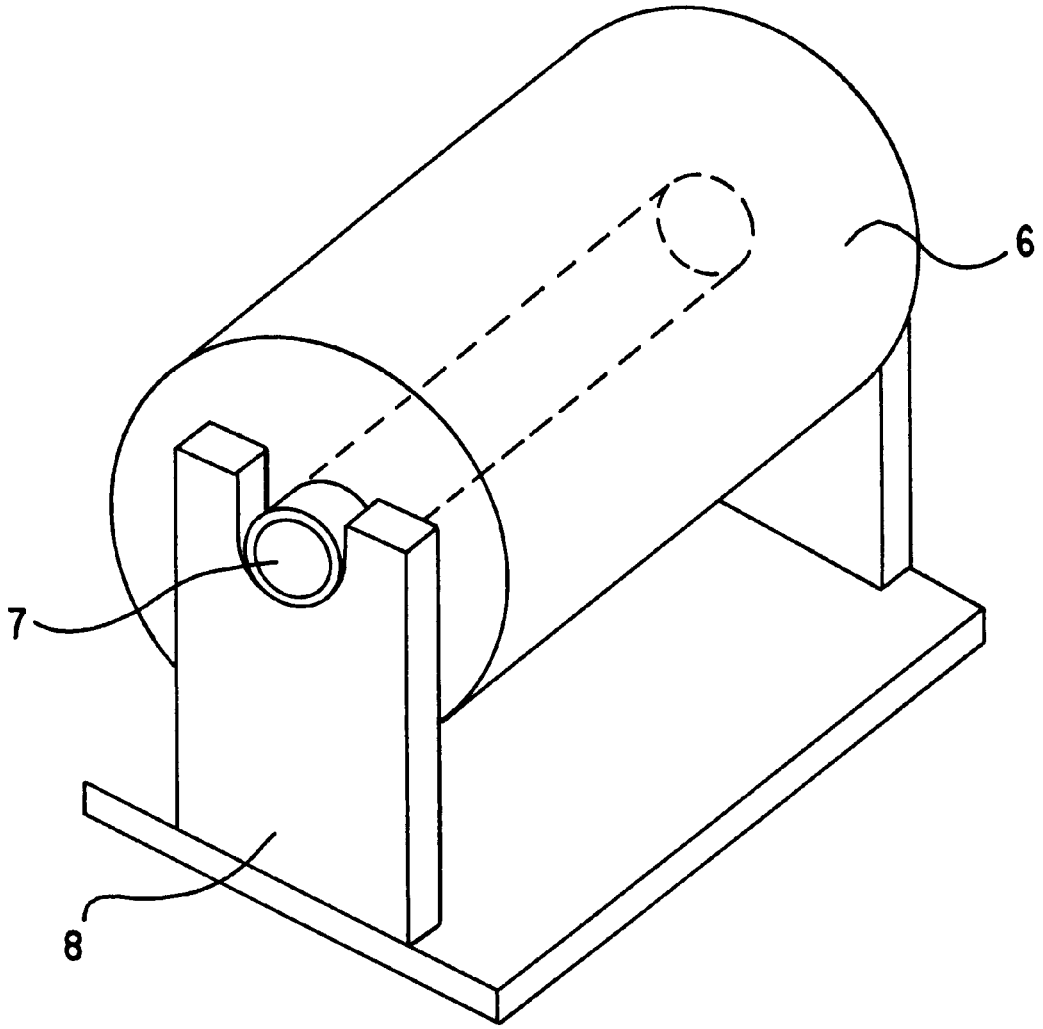
Fig.3 PRIOR ART
FIG. 3 is a perspective view of conventional holder bases for carriage of a rolled article with which a rolled article is held in a suspended state.

FIG. 3 shows conventional holder bases for carriage of a rolled article. Paper tube 7 of rolled cylindrical article 6 is supported with holder base 8, and cylindrical article 6 is held in a suspended, whereby a large load is imposed to the lower portion of holder base 8. It is required to reinforce entire strength of an enclosing box since a load is concentrated to a fixing portion of lower ends of holder base 8.

Figure 4:
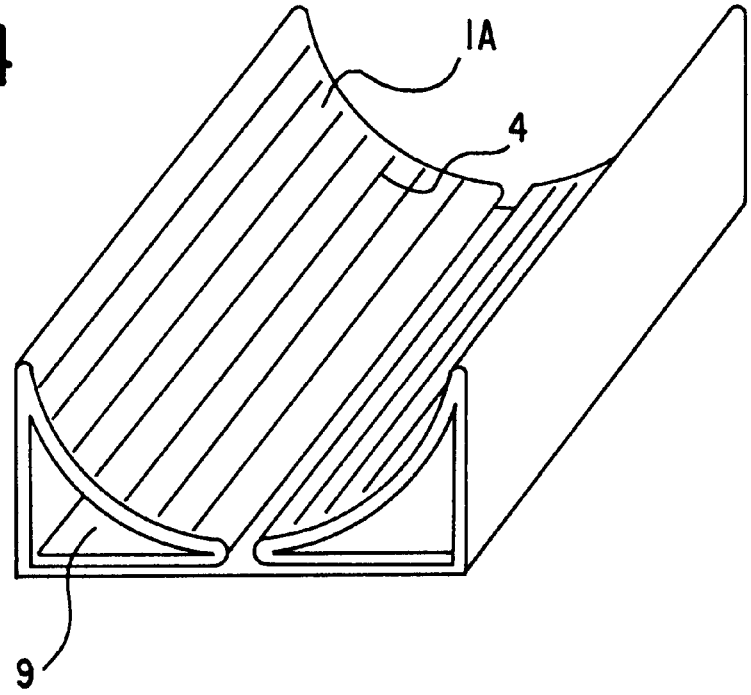
FIG. 4 is a perspective view of an embodiment of the appliance of the present invention.

FIG. 4 is a case wherein the proximate triangular prism is proximate right angled triangular prism 9. In this case, when a diameter of cylindrical article 6 is larger than a length of base plane portion 2, floated space 6 is formed.

Figure 5:
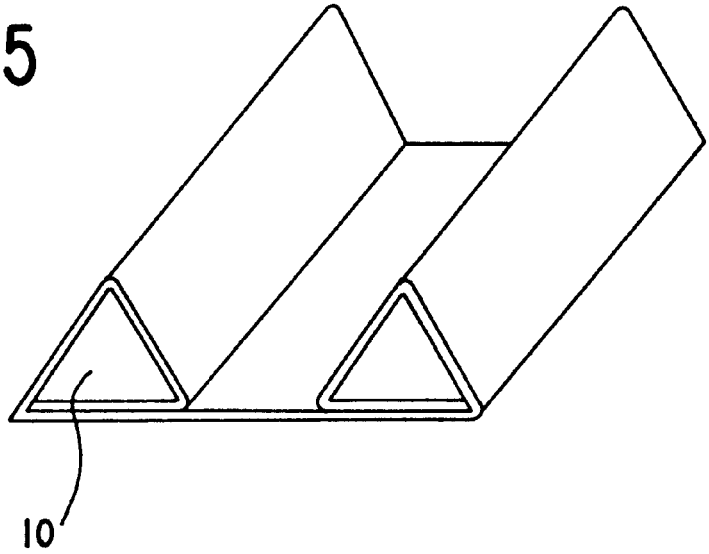
FIG. 5 is a perspective view of an appliance for supporting carriage of a cylindrical article wherein the proximate triangular prism is a proximate equilateral triangular prism.

FIG. 5 is a case wherein the proximate triangular prism is proximate equilateral triangular prism 10. In this case, when cylindrical article 6 is loaded on the present appliance, floated space 3 cannot be formed. In this case, only function to prevent rolling-over of cylindrical article 6 is provided.

Figure 6:
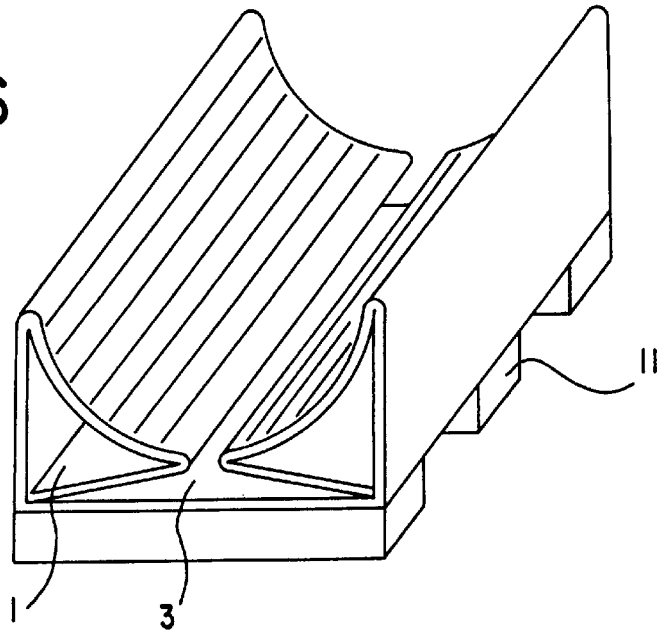
FIG. 6 is a perspective view of the appliance of the present invention provided with griders in the bottom section.

FIG. 6 is a case wherein grider 11 is provided in the bottom section of base plane portion 3. Conventional pallet becomes unnecessary by providing grider 11.

Figure 7:
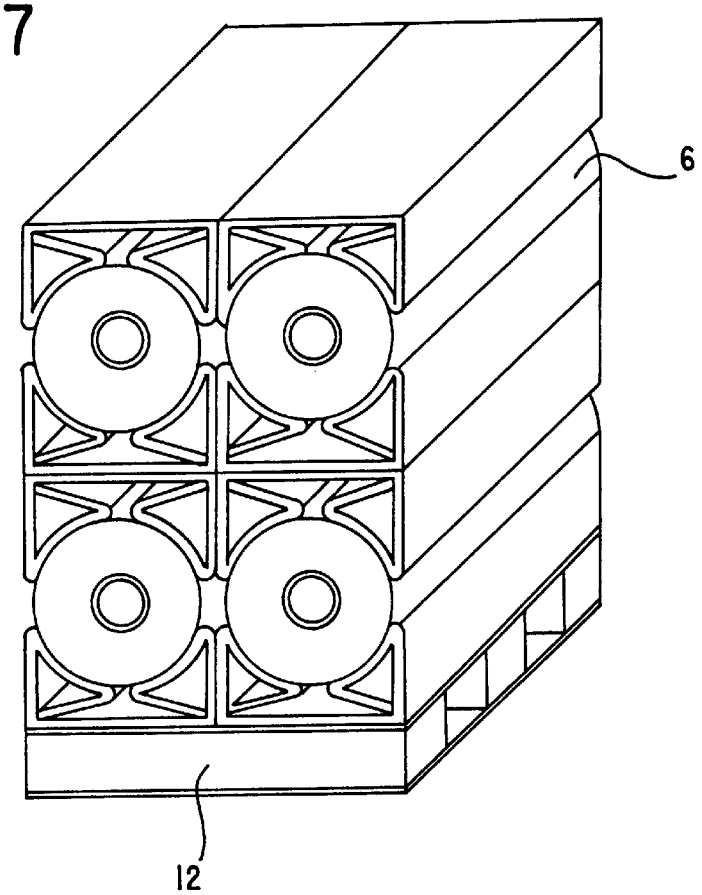
FIG. 7 is a perspective view showing an example in which cylindrical articles are loaded on each step using plural appliances of the present invention.

FIG. 7 is a case wherein cylindrical article 6 on each step using the plural present appliances is loaded. When such loading method is applied, no enclosing box is required and a higher loading efficiency than that of conventional pyramid type loading method is provided.

Figure 8:
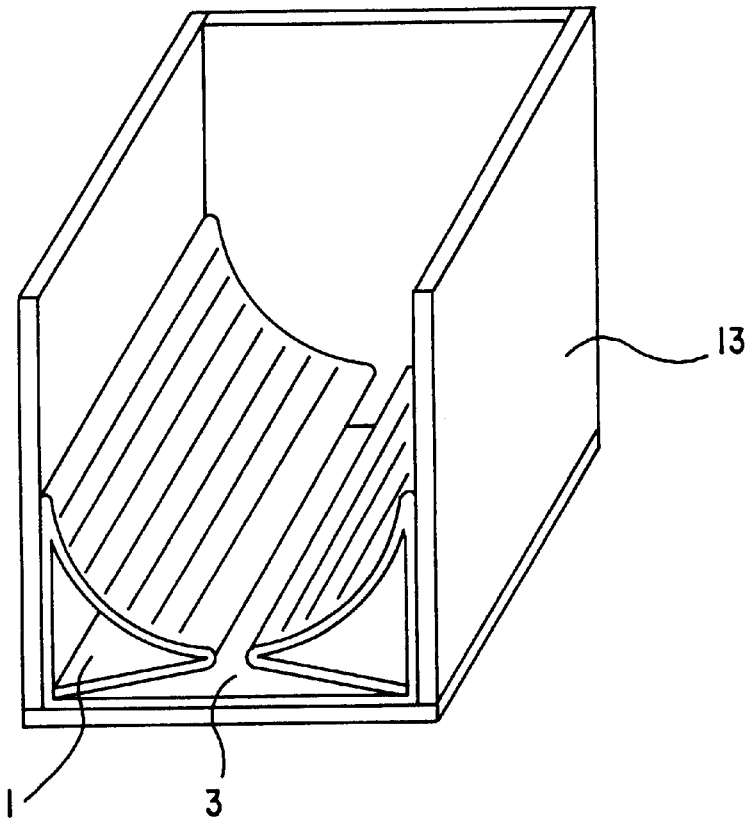
FIG. 8 is a perspective view showing an example of the appliance of the present invention enclosed in a box.

FIG. 8 is a case wherein the present appliance is enclosed in enclosing box 13. When light shielding is required in carriage of photograph film, this case is applied.

Figure 9:
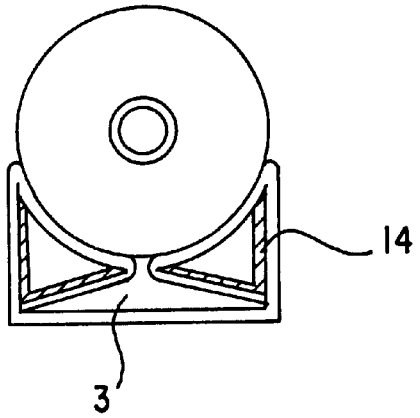
FIG. 9 is a front view showing an example in which both a beam plane and a perpendicular plane of the appliance of the present invention are reinforced with a reinforcing plate.

FIG. 9 is a case wherein reinforcing plate 14 is provided with both beam plane 1B and perpendicular plane 1C of the present appliance. The strength of the present appliance is sharply reinforced by providing reinforcing plate 14. As reinforcing plate 14, a cardboard sheet, a synthetic resin plate or a wood synthetic plate is used.

Figure 10:
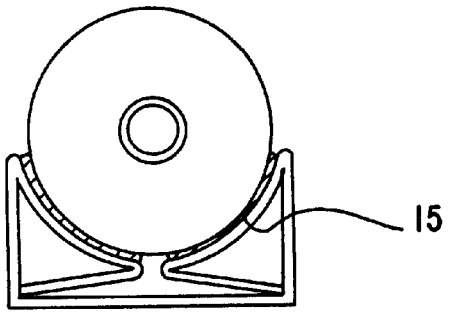
FIG. 10 is a front view showing an example in which a buffer material is provided on a loading face of the appliance of the present invention.

FIG. 10 is a case wherein buffer material 15 is provided on loading face 1A of the present appliance. When soft cylindrical article 6 is loaded, buffer material 15 is provided on loading face 1A in order to protect it. As buffer material 15, an air cap or a foamed sheet is used.

As described above, when the present appliance is applied to loading of a rolled article or a non-rolled cylindrical article, it can be carried stably with less vibration or impact and furthermore working of loading or unloading of the cylindrical article becomes easy, so that a labor is more remarkably lightened than that of conventional working for enclosing into an enclosing box and taking out.

The present appliance is made easily from a cheap cardboard sheet. Further, assembled package on each step leads to further cost-down.

What is claimed is:

1. An appliance for supporting carriage of a cylindrical article which consists essentially of two proximate triangular prisms portion comprising a curved loading face of a cylindrical article with fold lines, a beam plane and a perpendicular plane and a base plane portion, wherein said two proximate triangular prisms portion is formed in the state approached to each other in parallel by bending both ends of a square cardboard sheet to a proximate triangle form in cross section toward inside of the square cardboard sheet and a floated space is formed between said two beam planes of said two proximate triangular prisms portion and said base plane portion during loading of a cylindrical article.

2. An appliance according to claim 1, wherein said proximate triangular prism is a proximate isosceles triangular prism or a proximate right angled triangular prism.

3. An appliance according to claim 1, wherein said beam plane or said perpendicular plane of said two proximate triangular prisms portion is provided with a reinforcing plate.

* * * * *